US007735202B2

(12) United States Patent
Duda et al.

(10) Patent No.: US 7,735,202 B2
(45) Date of Patent: Jun. 15, 2010

(54) APPARATUS ON A SPINNING PREPARATION MACHINE FOR ASCERTAINING THE MASS AND/OR FLUCTUATIONS IN THE MASS OF A FIBRE MATERIAL

(75) Inventors: Günter Duda, Mönchengladbach (DE); Franz-Josef Minter, Mönchengladbach (DE)

(73) Assignee: Truetzscler GmbH & Co. KG, Moenchengladbach (DE)

( * ) Notice: Subject to any disclaimer, the term of this patent is extended or adjusted under 35 U.S.C. 154(b) by 1065 days.

(21) Appl. No.: 11/434,177

(22) Filed: May 16, 2006

(65) Prior Publication Data

US 2006/0260100 A1 Nov. 23, 2006

(30) Foreign Application Priority Data

May 20, 2005 (DE) ..... 10 2005 023 992

(51) Int. Cl.
*D01H 5/32* (2006.01)

(52) U.S. Cl. ..... 19/239

(58) Field of Classification Search ..... 19/239
See application file for complete search history.

(56) References Cited

U.S. PATENT DOCUMENTS 5,461,757 A * 10/1995 Leifeld ..... 19/239
5,544,390 A * 8/1996 Hartung et al. ..... 19/240
5,630,251 A * 5/1997 Leifeld ..... 19/291
5,673,462 A * 10/1997 Leifeld ..... 19/288
5,796,635 A * 8/1998 Dammig ..... 702/170
6,088,882 A * 7/2000 Leifeld ..... 19/239
6,189,879 B1 2/2001 Conner et al.
6,223,609 B1 5/2001 Leifeld et al.
6,289,599 B1 * 9/2001 Leifeld et al. ..... 33/501.02
6,292,982 B1 * 9/2001 Breuer ..... 19/239
6,336,256 B1 * 1/2002 Naf et al. ..... 19/65 A (Continued)

FOREIGN PATENT DOCUMENTS

CH 681899 A5 6/1993

(Continued)

OTHER PUBLICATIONS

United Kingdom Search Report dated Oct. 3, 2006 issued in GB Application No. 0609693.7.

(Continued)

*Primary Examiner*—Shaun R Hurley
(74) *Attorney, Agent, or Firm*—Venable LLP; Robert Kinberg; Leigh Thelen

(57) ABSTRACT

In an apparatus on a spinning preparation machine, for example a flat card, roller card, draw frame, combing machine or the like, for ascertaining the mass and/or fluctuations in the mass of a fiber material, for example at least one fiber sliver, fiber web or the like, of cotton, synthetic fibers or the like, the fiber material is scanned mechanically by a feeler element the excursions of which are converted into electrical signals. In order to facilitate improved and more accurate measurement of the fiber in a way that is simple in terms of structure and installation, a contactless distance sensor is provided for detecting the position of the feeler element, the sensor being a sensor that measures distance using transmitted waves, and is connected to an electronic evaluating device.

30 Claims, 9 Drawing Sheets

U.S. PATENT DOCUMENTS

| | | | | |
|---|---|---|---|---|
| 6,430,781 | B1 * | 8/2002 | Breuer et al. | 19/239 |
| 6,453,514 | B1 * | 9/2002 | Breuer et al. | 19/239 |
| 6,457,209 | B1 * | 10/2002 | Breuer et al. | 19/239 |
| 6,543,092 | B2 * | 4/2003 | Breuer | 19/236 |
| 6,874,204 | B2 | 4/2005 | Dammig et al. | |
| 7,103,440 | B2 | 9/2006 | Dammig et al. | |
| 2007/0028422 | A1 | 2/2007 | Minter | |

FOREIGN PATENT DOCUMENTS

| | | | |
|---|---|---|---|
| DE | 904873 | C | 2/1954 |
| DE | 7211136 | | 3/1972 |
| DE | 4012551 | C1 | 6/1991 |
| DE | 41 06 567 | A1 | 9/1991 |
| DE | 4125450 | A1 | 2/1993 |
| DE | 4404326 | A1 | 10/1994 |
| DE | 295 11 632 | U1 | 11/1995 |
| DE | 4414972 | A1 | 11/1995 |
| DE | 19500189 | A1 | 7/1996 |
| DE | 196 09 781 | A1 | 10/1996 |
| DE | 195 38 496 | A1 | 2/1997 |
| DE | 19538496 | A1 | 2/1997 |
| DE | 19543229 | A1 | 5/1997 |
| DE | 198 19 728 | A1 | 3/1999 |
| DE | 29823928 | | 3/2000 |
| DE | 19908371 | A1 | 8/2000 |
| DE | 101 24 433 | A1 | 11/2002 |
| EP | 0 329 081 | A1 | 8/1989 |
| FR | 2 252 550 | | 6/1975 |
| FR | 2 316 173 | | 1/1977 |
| FR | 2 703 446 | | 4/1994 |
| FR | 2 726 292 | | 5/1996 |
| FR | 2 768 437 | | 9/1998 |
| GB | 2225634 | A | 6/1990 |
| GB | 2306221 | A | 4/1997 |
| JP | 5033224 | A | 2/1993 |
| JP | 9195138 | | 7/1997 |
| WO | WO-98/18985 | | 5/1998 |

OTHER PUBLICATIONS

French Patent Office Preliminary Search Report and Written Opinion dated Dec. 16, 2008, issued in corresponding French Patent Application No. 651851, along with its corresponding English language translation.

British Search Report dated Dec. 13, 2006 issued in GB 0613865.5. which is the priority document for related U.S. Appl. No. 11/485,378.

German Search Report dated Nov. 25, 2005 issued in DE 10 2005 033 180.7, which is the priority document for related U.S. Appl. No. 11/485,378.

* cited by examiner

I-I

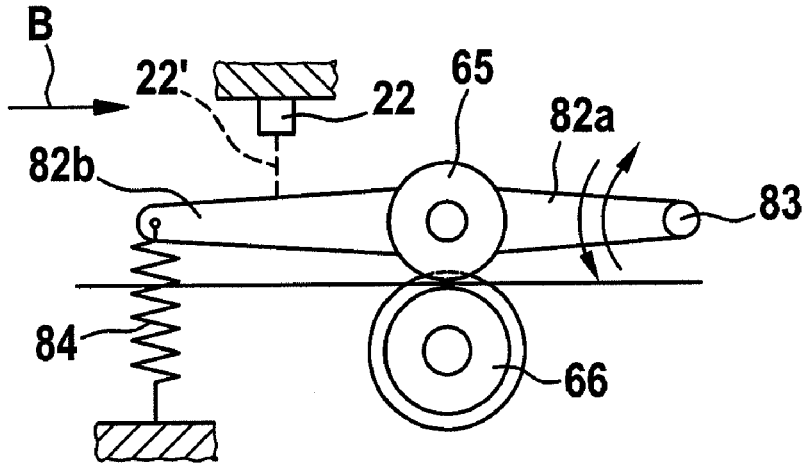
Fig.9
Fig.10
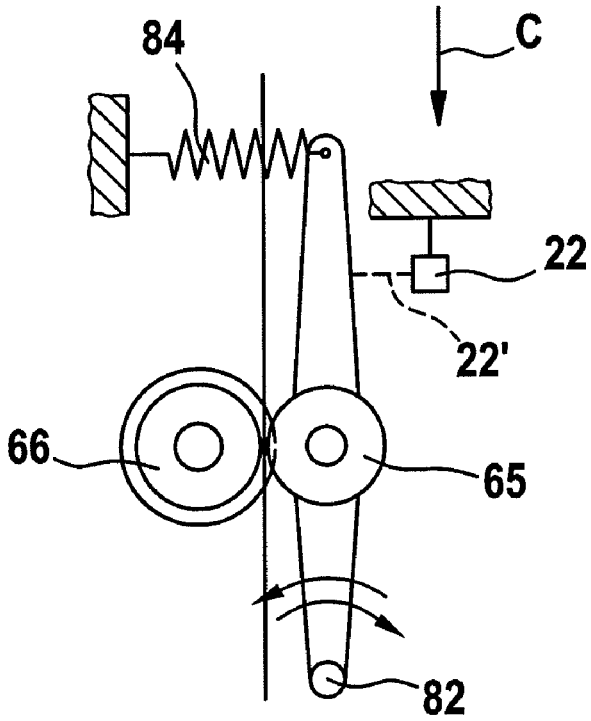

APPARATUS ON A SPINNING PREPARATION MACHINE FOR ASCERTAINING THE MASS AND/OR FLUCTUATIONS IN THE MASS OF A FIBRE MATERIAL

CROSS REFERENCE TO RELATED APPLICATION

This application claims priority from German Patent Application No. 10 2005 023 992.7, dated May 20, 2005, the entire disclosure of which is included herein by reference.

BACKGROUND OF THE INVENTION

The invention relates to an apparatus on a spinning preparation machine, for example a flat card, roller card, draw frame, combing machine or the like, for ascertaining the mass and/or fluctuations in the mass of fibre material, for example at least one fibre sliver, fibre web or the like, of cotton, synthetic fibres or the like.

The invention relates to the contact pressure of a feeler device on a fibre bundle in a sliver guide means, such as is used for measuring the thickness of fibre bundles on a textile machine. Such a textile machine can be a flat card, a draw frame, a flyer or a combing machine. The contact pressure of the feeler device is important for the formation of a correct measurement signal relating to the thickness of the fibre bundle. The measurement signal relating to thickness is important for controlling other processes on the textile machine. In order to ascertain the thickness of a fibre bundle, the fibre bundle is guided over a sliver guide means that is installed in fixed position. Such a sliver guide means can be a feeler roller which is fixed with its rotational axis, or a rod, a sliver guide channel or a sliver funnel. The fibre bundle is in contact with the sliver guide means and is guided thereby. A feeler device is pressed onto the fibre bundle guided in the sliver guide means. The contact pressure is provided by a spring which is under tension and is connected to the feeler device. The feeler device is movably mounted, that is to say in dependence upon the thickness of the fibre bundle being conveyed the feeler device moves at a distance from the sliver guide means. In so doing the feeler device can perform a pivoting movement or a back and forth movement. The feeler device is arranged with a signal converter which detects the movement of the feeler device and converts it into an electrical measurement signal. The feeler device can be, for example, a movable feeler roller. The movable feeler roller is pressed onto the fixed feeler roller. The movable feeler roller can be arranged in a pivot arm or reciprocating carriage. A spring engages the pivot arm or the reciprocating carriage and provides the contact pressure. A feeler device is also to be understood as being a feeler element which, diagrammatically, may take the form of a finger. Such a feeler element projects towards the sliver guide means in the conveying direction. The portion of the feeler element that is in contact with the fibre bundle is in the form of a slide surface. The feeler element is movable vertically and at a right angle to the running direction of the fibre bundle. Because the feeler element is in the form of a lever arm, it is pressed by springs in the direction of a fixed slide surface of a sliver guide channel or of a sliver funnel. The sliver guide channel or sliver funnel corresponds to a sliver guide means. The thickness of the fibre bundle is ascertained by means of the movement of the feeler element. A connected signal converter converts the amount of movement into an equivalent electrical signal. The term "fibre material" is to be understood as meaning a fibre bundle such as a fibre web, a fibre sliver twisted from a plurality of slivers, a drafted fibre sliver or a fibre tuft web, a fibre tuft feed.

A known apparatus (DE 195 38 496 A) has a pair of feeler rollers, the spacing of one of the feeler rollers being variable relative to the other and its excursion relative to an inductively operating contactless displacement sensor being determined by means of a lever arm having a pivot joint. The output signal of the displacement sensor is transmitted by means of a signal converter, which may be a proportional element, to a measured value memory which is able to change the drive speed of the middle and inlet rollers of the drafting system by way of a desired value step. A disadvantage is that such displacement sensors are electrically connected to a shielded control line by way of a special inbuilt connector. On account of the anti-inductive protection, that is to say the protection against induction voltage or induction currents, the control line consists of a special-purpose line. In order to prevent any interference effects on the measurement signal, that line must be connected in accordance with EMC (electromagnetic compatibility) guidelines. It should also be borne in mind that the counter-element must consist of a metallic material and the sensor has a certain stray field. A further problem is that the sensor is temperature-dependent. In addition, the amount of space required for certain applications, in which small dimensions are a factor, is too large.

It is an aim of the invention to provide an apparatus of the kind described at the beginning which avoids or mitigates the said disadvantages, which is, especially, simple in terms of structure and installation and which allows improved and more accurate measurement of the fibre bundle.

SUMMARY OF THE INVENTION

The invention provides an apparatus on a spinning preparation machine for ascertaining a parameter related to mass of a fibre material structure, comprising:

- a feeler element for mechanically scanning the mass of the fibre material; and
- a sensor device for detecting the position of the feeler element;
- wherein the sensor device comprises a distance sensor that, for determining the position of the feeler element, is arranged to detect a transmitted wave, the sensor device being connected to an electrical evaluating device.

The contactless distance sensor according to the invention allows improved and accurate measurement in a structurally simple way. Instead of an inductive field there are used electromagnetic waves, especially light waves, for example lasers, or acoustic waves, for example ultrasound. The use of light, especially laser light, allows focussed scanning of the measuring tongue or of a counter-element associated with the measuring tongue, so that the measuring tongue can have small dimensions and allows high frequencies/CV values to be detected. That advantage is also obtained when lightweight non-metallic materials are used for the feeler element, for example ceramics, fibre-reinforced materials or the like. The evaluation can take place either in the vicinity of the measuring point or in a control box if the optical signals are conducted from the measuring point to the evaluating unit by means of optical waveguides. Further advantages are obtained as a result. Because the optical waveguide is not subject to any inductive interference effects, a connection in accordance with EMC guidelines becomes unnecessary. Such contactless distance measurement also ensures that measurement can be absolutely precise. The measurement is wear-free, temperature-independent, free of electrical interference effects (measurement data are transported by light guides) and contaminants are avoided by virtue of the continuous cleaning of the measuring funnel. In addition to the advantage of the very simple installation of the optical distance sensor and/or the optical waveguides, it is additionally possible, depending upon the measuring process, to carry out fresh calibration of the measuring funnel at any time using an existing control means that evaluates the measurement signal. The calibration of the measuring funnel is effected on initial start-up. A further advantage is that the measurement path of the feeler tongue excursion is programmable to be fixed or variable. A further advantage is the considerable reduction in the weight of the feeler tongue. Because it is possible to use an optical distance sensor/optical waveguide to view any point of the feeler tongue inside the measuring funnel, the weight of the feeler tongue can be reduced to an absolute minimum (allowing for a new measuring method for high frequencies). The resulting reduction in weight allows a substantially higher sensing frequency of the feeler tongue, because its natural resonance is shifted towards a higher frequency. Accordingly, the control means is also able to ascertain and display very high realistic CV values.

On the basis of such a contactless measuring process it is also possible to implement the measurement of the fibre material using a driven tongue-and-groove roller. In addition to improved sliver quality resulting from the transport of the fibres, a further advantage is that the driven tongue-and-groove roller can replace a separate delivery roller and can therefore fulfil two functions at the same time (measurement of the fibre density and transport of the fibre material). By virtue of this measure, an output measuring funnel and condenser become entirely unnecessary. As a result of the contactless distance measurement, the measurement point for ascertaining the fibre density at the delivery rollers (tongue/groove) can be directly at the rollers or alternatively on the roller journals.

The distance sensor may ascertain the distances relative to the feeler element. Instead, the distance sensor may ascertain the distances relative to a counter-element associated with the feeler element. In one embodiment, the distance sensor is fixed and the counter-element is movable relative to the distance sensor. In another embodiment, the distance sensor is movable and the counter-element is fixed relative to the distance sensor. Advantageously, the counter-element has a flat scanning surface. Advantageously, the counter-element has a smooth scanning surface. Advantageously, the counter-element has a curved scanning surface. Advantageously, the scanning surface is reflective. In certain preferred arrangements, an optical distance sensor (sensor that measures distance) is used. In certain other preferred arrangements, an acoustic distance sensor (sensor that measures distance) is used. The sensor may be an ultrasound distance sensor (sensor that measures distance). Advantageously, the light beam or sound beam is focussed. The distance sensor may be a light scanner. Advantageously, the distance sensor has a transmitter and a receiver. The distance sensor may be a laser scanner. The distance sensor may use visible light. The distance sensor may use infrared light. Advantageously, the distance sensor for position determination is mounted at an angle of 90° relative to the distance surface of the counter-element. Advantageously, the distance sensor and the counter-element are arranged in a closed housing. Advantageously, the evaluating device is connected to an electronic control and regulation device. Advantageously, the distance sensor is an analog sensor. In certain arrangements, the apparatus can be used for ascertaining and displaying undesired winding about a roller. In certain further arrangements, the apparatus can be used for ascertaining and displaying sliver breakage. In one advantageous embodiment, the signals are conducted from the measuring point to the evaluating unit using an optical waveguide.

In certain preferred embodiments, the distance sensor scans the excursions of a movable feeler tongue. In certain other preferred embodiments, the distance sensor scans the excursions of a movable feeler roller. The distance sensor may scan the excursions of the feeler tongue or of the feeler roller directly or indirectly. In one advantageous arrangement, the distance sensor is used for ascertaining the sliver mass of an elongate substantially untwisted fibre bundle. Advantageously, the fibre bundle consists substantially of natural fibres, especially of cotton, and/or synthetic fibre materials. Advantageously, the distance sensor is used to measure the sliver mass in a continuously moving fibre bundle. Advantageously, the ascertained values for the sliver mass are used for levelling fluctuations in the sliver mass of the fibre bundle by controlling at least one drafting device of a spinning preparation machine in which the fibre bundle is being drafted. Advantageously, the spinning preparation machine is a regulated flat card, a flat card having an autoleveller drafting system, a combing machine having a drafting system with or without an autoleveller, or is a draw frame.

In an advantageous embodiment, the means for ascertaining the sliver mass of a moving fibre bundle is provided on a spinning preparation machine having a plurality of successive drafting devices for drafting the fibre sliver. The distance sensor(s) may be arranged at the inlet and/or outlet of a drafting system of the spinning preparation machine. Advantageously, the fluctuations in sliver mass are monitored at the inlet and/or at the outlet and, if necessary, the spinning preparation machine is switched off and/or a warning signal is given in the event of the sliver mass or fluctuations in sliver mass falling below or exceeding threshold values. Advantageously, the distance sensor is configured for detecting sliver breakages in the fibre bundle or a fibre sliver of the fibre bundle. In one advantageous arrangement, on the basis of calculated values for the sliver mass, a regulating unit of the spinning preparation machine effects open-loop control of at least one of the drafting devices for evening out sliver mass fluctuations (inlet autolevelling). In another advantageous arrangement, on the basis of calculated values for the sliver mass, a regulating unit of the spinning preparation machine effects closed-loop control at least one of the drafting devices for evening out sliver mass fluctuations (outlet autolevelling). Advantageously, inlet and outlet autolevelling means form an intermeshed control system (simultaneous open-loop and closed-loop control).

Advantageously, the measuring frequency with which the resonance frequency adaptations are carried out is matched to the inlet speed of the fibre bundle entering the spinning preparation machine or to the delivery speed of the fibre bundle leaving the spinning preparation machine. Advantageously, the measuring frequency is adapted to a fixed, preferably constant, scanning length (length-oriented scanning). Advantageously, the measuring frequency is adapted to a fixed time period (time-oriented scanning) which depends upon the speed of the fibre bundle. Advantageously, the scanning which detects a certain portion of the fibre bundle per measurement is carried out in a plurality of overlapping measurements displaced relative to one another along the fibre bundle. Advantageously, a spectrogram or a portion of a spectrogram of the fibre bundle is created or supplemented on the basis of measured values obtained by means of the at least one distance sensor. Advantageously, a spectrogram of the fibre bundle is recorded at the inlet and/or at the outlet of the spinning preparation machine. Advantageously, a plurality of fibre slivers is guided through the spinning preparation machine from the inlet to the outlet one next to the other and, in plan view, substantially parallel to one another. Advantageously, the fibre bundle or individual groups of fibre slivers forming the fibre bundle are passed through at least one funnel or through guide elements, for example guide plates or guide rods. The guide element may be a sliver guide means. The guide element may be a web guide means. Advantageously, the walls of the guide element are at least partly of conical construction and a pair of rollers is arranged downstream of the sliver or web guide means, wherein there is a loaded, movable feeler element which, together with a fixed counter-surface, forms a constriction for the fibre bundle, which consists of at least one fibre sliver, passing through and a change in the position of which feeler element in the event of a variation in the thickness of the fibre bundle acts on a converter device to generate a control pulse. Advantageously, the feeler element is associated with a sliver guide means, the plurality of fibre slivers is condensed and scanned in one plane in the sliver guide means and the pair of rollers withdraws the scanned fibre slivers. Advantageously, the feeler element is associated with a sliver funnel through which a fibre sliver passes. The feeler element may be mounted, for example, on a fixed pivot bearing. Advantageously, the feeler element is a pivotally mounted lever. Advantageously, the feeler element cooperates with a force element, for example a counter-weight, spring or the like. The feeler element may be mounted so as to be movable in the horizontal direction. Advantageously, the feeler element is resiliently mounted at one end. Advantageously, the feeler element is mounted on a holding member, for example a lever. Advantageously, the feeler element is mounted so as to be pivotable about a vertical axis. Advantageously, the bias of the movably mounted feeler element is effected by mechanical, electrical, hydraulic or pneumatic means, for example springs, weights, natural resilience, loading cylinders, magnets or the like, and can be adjustable. The axes of the delivery rollers at the outlet may be arranged horizontally. The axes of the delivery rollers at the outlet may be arranged vertically. Advantageously, control pulses are supplied to a regulator. Advantageously, the regulator adjusts the speed of at least one drive motor of the drafting system. Advantageously, there is a plurality of distance sensors, each of which scans the thickness of a fibre sliver with a feeler element (individual sliver scanning). Advantageously, the displacements of the individual feeler elements can be added together.

The invention also provides a spinning preparation machine, especially a flat card, draw frame or combing machine, for carrying out a process of detecting the position of a feeler element, having at least one distance sensor for measuring the sliver mass of a continuously moving fibre bundle. Advantageously, the at least one distance sensor is arranged at the inlet of the spinning preparation machine. Advantageously, the at least one distance sensor is arranged at the outlet of the spinning preparation machine. Advantageously, the at least one distance is associated with an autoleveller unit which effects open-loop and/or closed-loop control of at least one drafting device of the spinning preparation machine on the basis of the measured values of the sliver mass of the fibre bundle. In one form of machine of the invention, a plurality of fibre slivers, running one next to the other and parallel to one another, are detectable by the at least one distance sensor. In another form of machine of the invention, a plurality of fibre slivers, running one next to the other and, in plan view, substantially parallel to one another, are guidable through the spinning preparation machine from the inlet to the outlet. Advantageously, guide means are provided upstream and downstream of the sensor for guiding the fibre bundle under tension. Advantageously, the guide means comprise rotating roller pairs between which the fibre bundle is clampable. Advantageously, the distance between the roller pair arranged upstream and/or downstream of the distance sensor and the distance sensor is very small. Advantageously, the guide means comprise at least one condensing element, in the form of a funnel, guide plates or guide rods, upstream of the at least one distance sensor for effecting convergence of the fibre bundle or individual groups of fibre slivers of the fibre bundle. Advantageously, the guide means comprise at least one condensing element having guide surfaces that rise transversely with respect to the longitudinal direction of the fibre bundle for bringing together the fibre bundle or individual groups of fibre slivers of the fibre bundle. Advantageously, at least one of the guide means is pivotable. Advantageously, between the sensor and a drafting system of the spinning preparation machine there are arranged guide elements for guiding the fibre slivers of the fibre bundle so that the fibre slivers cover substantially the same path between the distance sensor and the drafting system. Advantageously, the machine is in the form of a flat card having an autoleveller drafting system or in the form of a combing machine having an autoleveller drafting system, it being possible in each case for a drafting system without autolevelling to be arranged upstream of the autoleveller drafting system. Advantageously, it is in the form of a flat card or combing machine, the outlet of which can be associated with an autoleveller drafting system in the form of a module. Advantageously, the machine is in the form of a flat card at the outlet of which there is arranged at least one distance sensor instead of a mechanical displacement measuring sensor. Preferably, the distance sensor is a sensor that measures optical or acoustic distance.

The invention also provides an apparatus on a spinning preparation machine, for example a flat card, roller card, draw frame, combing machine or the like, for ascertaining the mass and/or fluctuations in the mass of a fibre material, for example at least one fibre sliver, fibre web or the like, of cotton, synthetic fibres or the like, in which the fibre material is scanned mechanically by a feeler element the excursions of which are converted into electrical signals, there being a contactless distance sensor for detecting the position of the feeler element (proximity sensor), characterised in that the distance sensor, using waves or rays, is a sensor that measures distance, which sensor is connected to an electrical evaluating device.

BRIEF DESCRIPTION OF THE DRAWINGS

Certain illustrative embodiments of the invention will be described in greater detail below with reference to the accompanying drawings, in which:

FIG. 9 is a side view of a tongue-and-groove roller pair in which a distance sensor is arranged opposite the loaded pivoting and holding arm of the feeler roller;

FIG. 10 shows a tongue-and-groove roller pair as in FIG. 9 in which a distance sensor is arranged opposite the feeler roller;

DETAILED DESCRIPTION OF CERTAIN PREFERRED EMBODIMENTS

Figure 1:
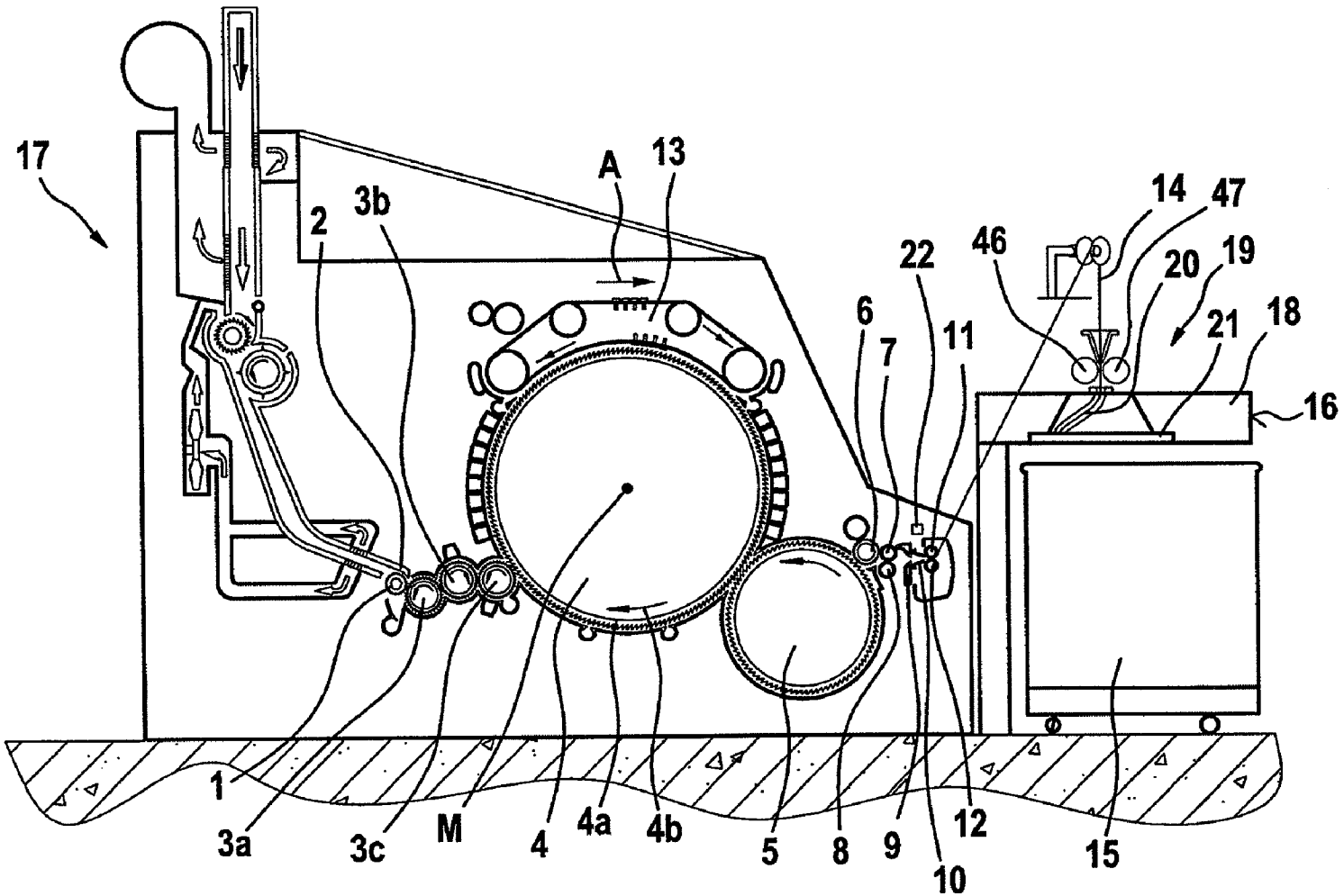
FIG. 1 is a diagrammatic side view of a flat card having a web funnel and a distance sensor according to the invention.

FIG. 1 shows a flat card, e.g. a flat card known as TC03™ made by Trützschler GmbH & Co. KG of Mönchengladbach, Germany, having a feed roller 1, feed table 2, lickers-in 3*a*, 3*b*, 3*c*, cylinder 4, doffer 5, stripper roller 6, nip rollers 7, 8, web guide element 9, web funnel 10, delivery rollers 11, 12, revolving card top 13 with card top guide rollers and card flat bars, can 15 and can coiler 16. A fibre bundle passes through the web funnel 10, the fibre bundle entering in the form of a fibre web (not shown) and being discharged in the form of a card sliver 14. The directions of rotation of the rollers are indicated by curved arrows. Reference letter M denotes the centre point (axis) of the cylinder 4. Reference numeral 4*a* indicates the clothing and reference numeral 4*b* indicates the direction of rotation of the cylinder 4. Arrow A indicates the working direction. A tuft feed device 17 is arranged upstream of the flat card. The coiling plate 19 is rotatably mounted in the coiling plate panel 18. The coiling plate 19 comprises a sliver channel 20 with an inlet and an outlet (see FIG. 3) for fibre sliver 14 and a revolving plate 21. The feeler arm (see, for example, FIG. 13) of the web funnel 10 is associated with an optical distance sensor 22 according to the invention.

Figure 2:
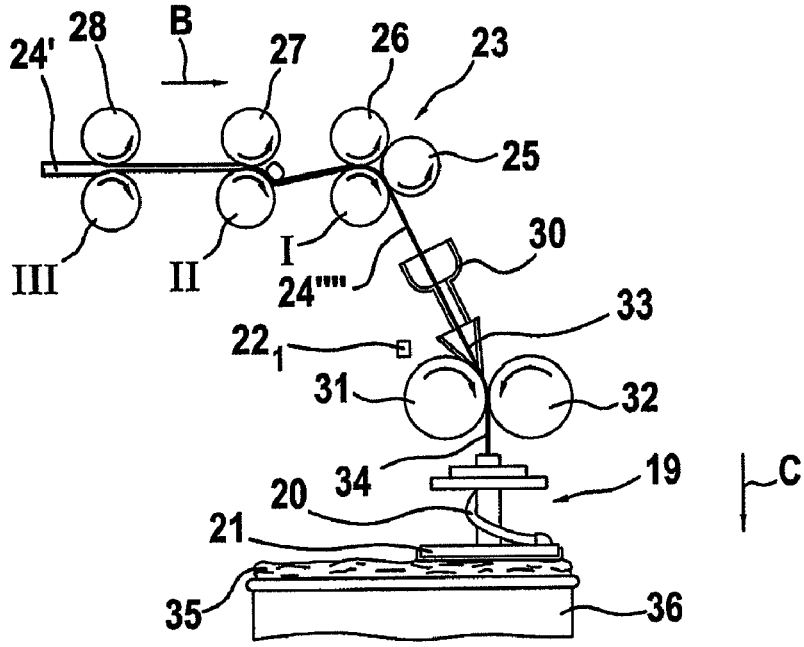
FIG. 2 is a diagrammatic side view of the drafting system of a draw frame having a sliver funnel and a distance sensor according to the invention.

In the embodiment of FIG. 2, a drawframe, for example a drawframe TD 03™ made by Trützschler GmbH & Co. KG. has a drafting system 23 having a drafting system inlet and a drafting system outlet. The fibre slivers 24, coming from cans (not shown), enter a sliver guide means and, drawn by delivery rollers, are transported past a measuring element (see FIG. 4). The drafting system 23 is configured as a 4 over 3 drafting system, that is to say it consists of three lower rollers I, II, III (I output lower roller, II middle lower roller, III input lower roller) and four upper rollers 25, 26, 27, 28. In the drafting system 23, the drafting of the fibre bundle 24', which consists of a plurality of fibre slivers, is carried out. The drafting operation is composed of the preliminary drafting operation and the main drafting operation. The roller pairs 28/III and 27/II form the preliminary drafting zone and the roller pairs 27/II and 25, 26/I form the main drafting zone. In the drafting system outlet, the drafted fibre slivers (fibre web 24'''') arrive at a web guide means 30 and are drawn by means of delivery rollers 31, 32 through a sliver funnel 33 in which they are combined to form a fibre sliver 34, which is then, by way of a can coiler and revolving plate 21, coiled in fibre sliver rings 35 in a can 36. Reference letters B and C denote the working directions. An optical distance sensor $\mathbf{22}_1$ according to the invention is associated with the feeler arm of the sliver funnel 33, which acts simultaneously as outlet measuring funnel.

Figure 3:
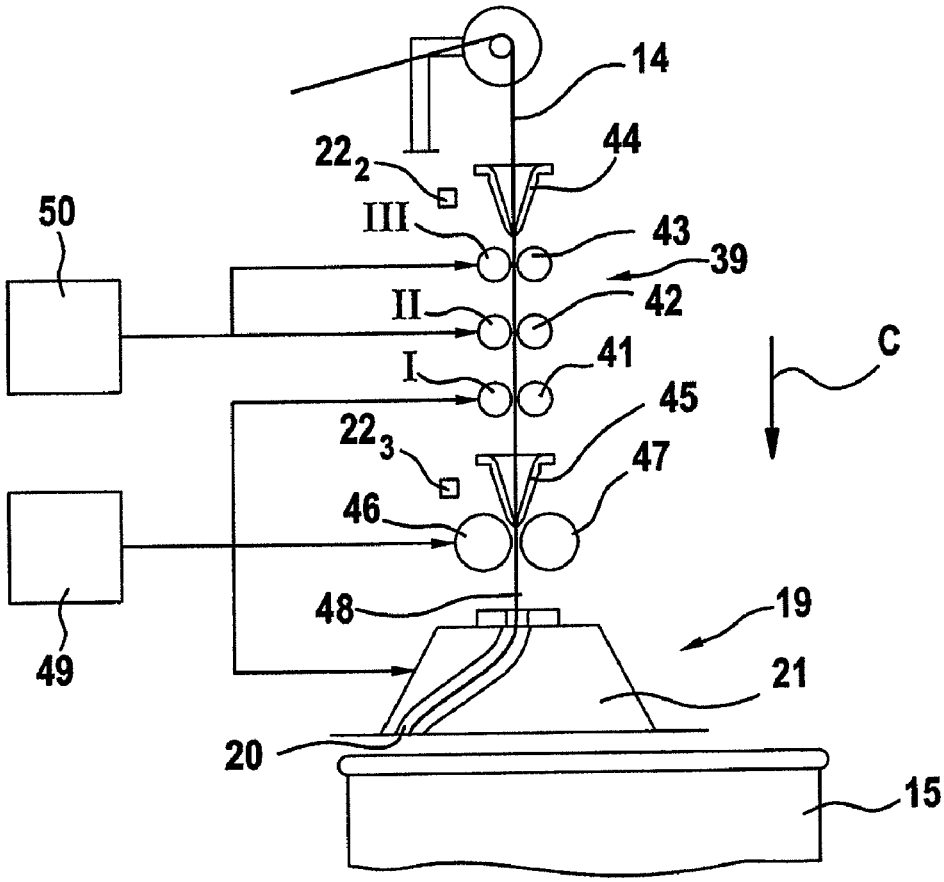
FIG. 3 is a diagrammatic side view of a flat card drafting system with inlet and outlet measuring funnels, each having a distance sensor according to the invention.

FIG. 3 shows an embodiment in which, between the flat card (see FIG. 1) and the coiling plate 19 (see FIG. 1), a flat card drafting system 39 is arranged above the coiling plate 19. The flat card drafting system 39 is configured as a 3 over 3 drafting system, that is to say it consists of three lower rollers I, II and III and three upper rollers 41, 42, 43. An inlet measuring funnel 44 is arranged at the inlet of the drafting system 39 and an outlet measuring funnel 45 is arranged at the outlet of the drafting system. The feeler arm 76*a* (which may be similar construction to the feeler arms 76, 76*b* of FIG. 7 or FIG. 13) of the inlet measuring funnel 44 and the feeler arm of the outlet measuring funnel 45 are each associated with an optical distance sensor according to the invention $\mathbf{22}_2$ and $\mathbf{22}_3$, respectively. Arranged downstream of the outlet funnel 45 are two delivery rollers 46, 47, which rotate in the direction of the curved arrows and draw the drafted fibre sliver 48 out of the outlet funnel 45. The outlet lower roller I, the delivery rollers 46, 47 and the coiling plate 19 are driven by a main motor 49, while the inlet and middle lower rollers III and II are driven by a regulating motor 50. The motors 49 and 50 are connected to an electronic control and regulation device (not shown) to which all distance sensors $\mathbf{22}_2$, $\mathbf{22}_3$ are also connected.

Figure 4:
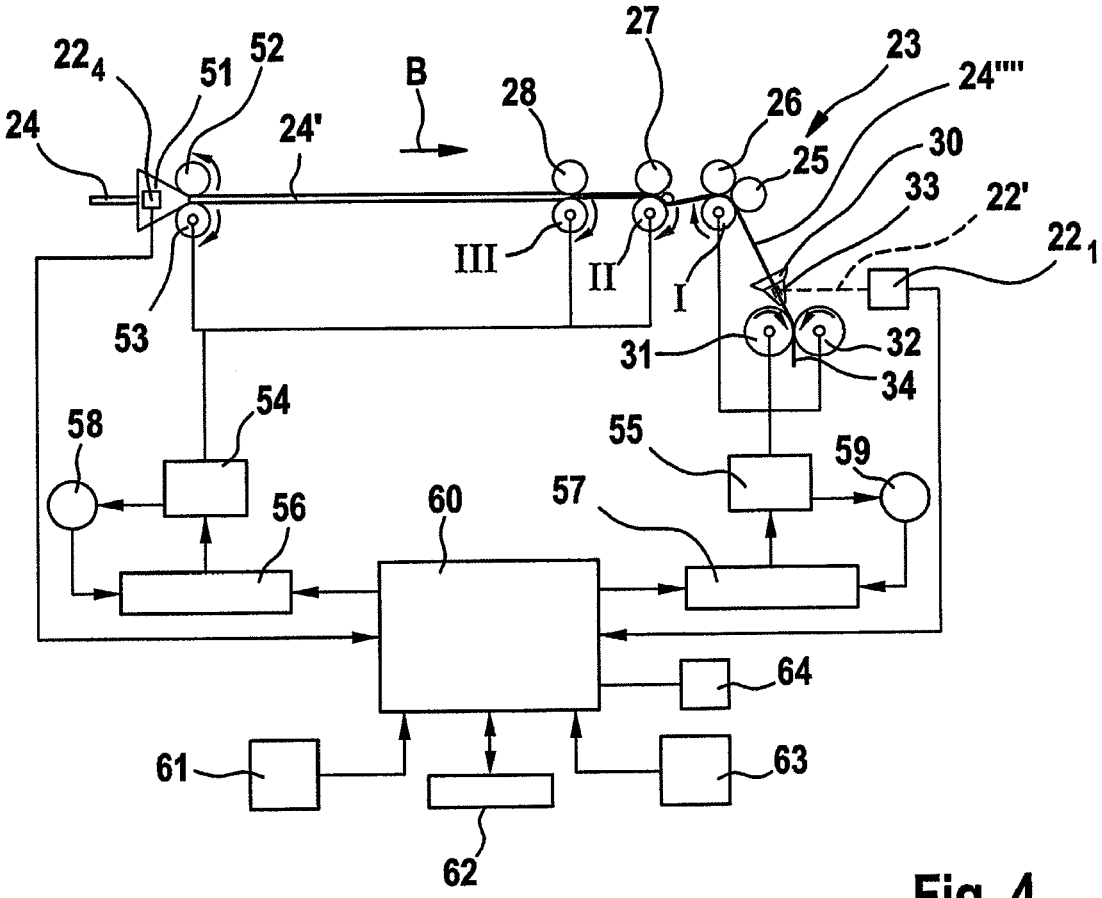
FIG. 4 is a diagrammatic block diagram for an autoleveller draw frame having two distance sensors according to the invention which are connected to an electronic open and closed-loop control device.

Referring to FIG. 4, in a draw frame that is similar in certain respects to the draw frame of FIG. 2, like parts of the apparatus are designated by the same reference numerals as in FIG. 2. A drafting system inlet is arranged upstream of the drafting system 23. A plurality of fibre slivers 24, coming from cans (not shown), enter a sliver guide means 51 and, drawn by the delivery rollers 52, 53, are transported past a loaded feeler arm 72 (see FIG. 6) in the sliver guide means 51, are discharged again by the delivery rollers 52, 53 in the form of a fibre bundle 24' and fed to the inlet rollers 28/III. The feeler arm 72 is associated with a distance sensor 224 according to the invention. The delivery rollers 52, 53, the inlet lower roller III and the middle lower roller II, which are mechanically coupled together, for example by means of toothed belts, are driven by the regulating motor 54, it being possible to specify a desired value. (The associated upper rollers rotate therewith.) The output lower roller I and the delivery rollers 31, 32 are driven by the main motor 55. The regulating motor 54 and the main motor 55 each has its own regulator 56 and 57, respectively. The regulation (speed regulation) is effected in each case by means of a closed regulating circuit, with a tachogenerator 58 being associated with the regulating motor 54 and a tachogenerator 59 being associated with the main motor 55. At the drafting system inlet, a variable proportional to the mass, for example the cross-section of the incoming fibre slivers 24, is measured by the inlet measuring device $\mathbf{22}_4$. At the drafting system outlet, the cross-section of the outgoing fibre sliver 34 is obtained by an outlet measuring device $\mathbf{22}_1$ associated with the sliver funnel 33. A central computer unit 60 (open and closed-loop control device), for example a microcomputer having a microprocessor, transmits a setting for the desired value for the regulating motor 54 to the regulator 56. The measured variables from the two measuring devices $\mathbf{22}_4$ and $\mathbf{22}_1$ are transmitted to the central computer unit 60 during the drafting operation. The measured variables from the inlet measuring device $\mathbf{22}_4$ and the desired value for the cross-section of the outgoing fibre sliver 34 are used in the central computer unit 60 to determine the desired value for the regulating motor 54. The measured variables from the outlet measuring element $\mathbf{22}_1$ are used for the monitoring of the outgoing fibre sliver 34 (output sliver monitoring). Using that closed-loop control system it is possible to compensate for fluctuations in the cross-section of the incoming fibre slivers 24, or to render the fibre sliver uniform, by appropriate closed-loop control of the drafting operation. Reference numeral 61 denotes a display screen, reference numeral 62 denotes an interface, reference numeral 63 denotes an input device and reference numeral 64 denotes a memory. The lower rollers I, II and III can each be driven by its own speed-controlled motor (in a manner not shown).

Figure 5A:
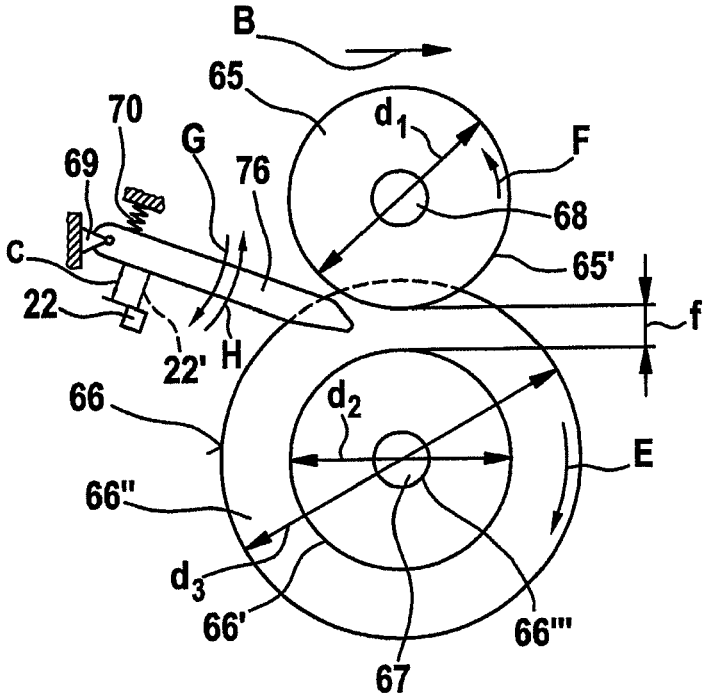
FIG. 5*a* is a side view of a configuration having a plurality of tongue-and-groove rollers and individual scanning with a plurality of distance sensors according to the invention.
Figure 5B:
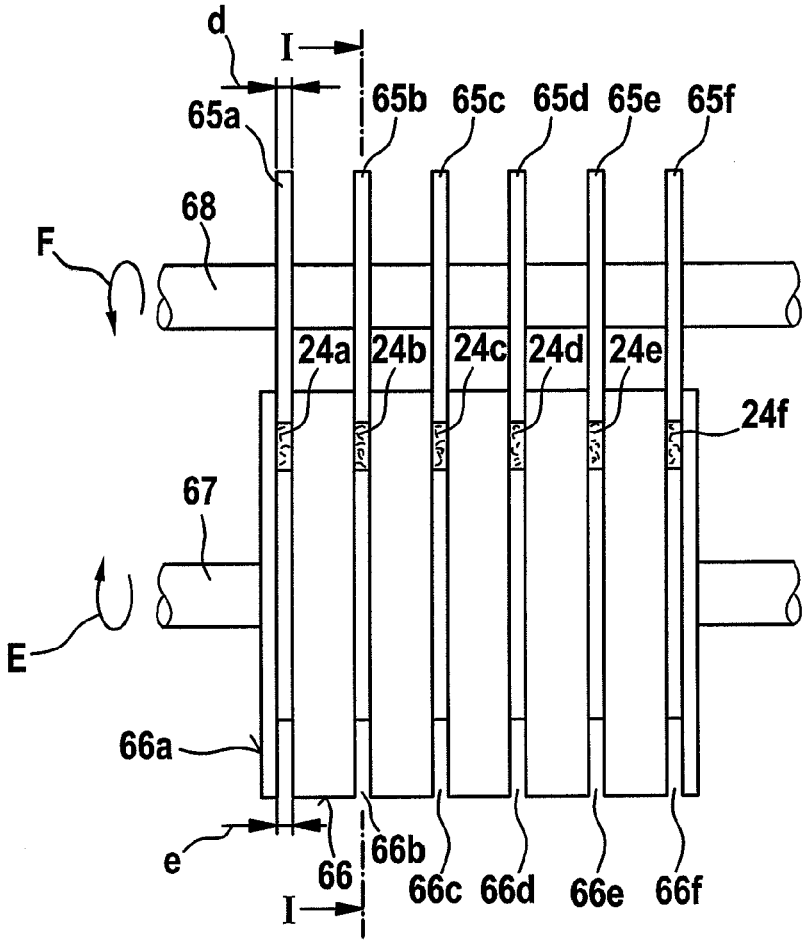
FIG. 5*b* is a front view in section I-I according to FIG. 5*a;*

In the embodiment of FIG. 5*b*, a plurality of tongue rollers 65*a* to 65*f* and groove rollers 66*a* to 66*f*—six of each in the example shown—is provided. The tongue rollers 65*a* to 65*f* have a width d which corresponds to the distance e between the groove side faces 66", 66'" of the groove rollers 66*a* to 66*f*. The tongue rollers 65*a* to 65*f* and the groove rollers 66*a* to 66*f* are in each case arranged on a common rotatable shaft 68 and 67, respectively. According to FIG. 5*a*, the outside surface 65' of the tongue and the base surface 66' of the groove are a distance f apart from one another. The diameters $d_1$ and $d_2$ of the tongue rollers 65*a* to 65*f* and the inner roller of the groove rollers 66*a* to 66*f* are the same. The diameter $d_3$ of the outer rollers of the groove rollers 66*a* to 66*f* is greater than $d_2$. The width of the feeler element 76 corresponds substantially to the spacings d and e. In operation, the fibre material 24 is condensed between the feeler elements 72, 76 (shown in FIGS. 5*a*,6 and 7) and the base surfaces 66' of the groove only to the extent necessary for scanning the thickness and/or irregularities, without transport in the direction B being impaired. In the roller nip between the surfaces 65', 66', 66", 66'", the fibre material is condensed only to the extent necessary for transport by the delivery rollers 65, 66. The fibre material need not be condensed to the actual material cross-section. The embodiment shown in FIGS. 5*a*, 5*b* allows individual sliver scanning. The measuring element has a plurality of feeler elements (only feeler element 76 is shown in FIG. 5*a*), each feeler element 76 being movably mounted on a pivot bearing 69 (shown in FIG. 5*a*) for displacement in the event of variations in the thickness of the respective fibre sliver 24*a* to 24*f* and each being biased by a spring 70, the displacements of the individual feeler elements 76 being added together. The construction according to FIG. 5*a*, 5*b* allows—seen in plan view—substantially or completely parallel guidance of the fibre slivers from the drafting system inlet, through the drafting system 23 as far as the web guide means 30 of the drafting system outlet. As a result, the fibre slivers 24*a* to 24*f* are prevented from converging, spreading out, being diverted or the like. The feeler elements 76 each cooperate with moving counter-surfaces 66'. In accordance with FIG. 5*a*, opposite the feeler element 76 on the side facing the groove base 66', i.e. facing away from the compression spring 70 there is arranged a distance sensor 22, e.g. a laser sensor, at a distance c. Reference numeral 22'indicates the scanning light beam, arrows F and E indicate the direction of rotation of the rollers 65 and 66 (including the shafts 67 and 68) and arrows G and H indicate the direction of pivoting of the feeler elements 76.

In the embodiment shown in FIGS. 5*a*, 5*b*, there can also be more than one fibre sliver in each roller nip. The incoming plurality of fibre slivers 24 are scanned by more than one scanning device. According to FIGS. 5*a*, 5*b*, the scanning device consists of a plurality of mechanical feeler elements and a plurality of distance sensors 22. The configuration in accordance with FIGS. 5*a*, 5*b* can also be modified (in a manner not shown) so that the excursions of the feeler elements 76 are transmitted mechanically to an integrating element and there is thus formed a mean value, with a single distance sensor 22 being arranged opposite and spaced apart from the common integrating element.

Figure 6:
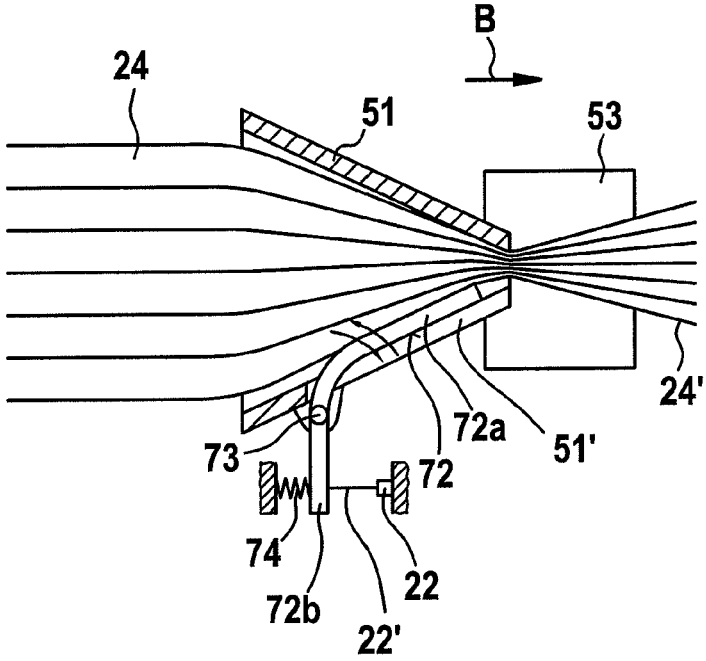
FIG. 6 is a plan view, in section, of the input-side sliver guide means for a plurality of fibre slivers upstream of the drafting system of a draw frame with a spring-loaded feeler element (double-armed lever) and a distance sensor opposite a force-loaded lever arm.

FIG. 6 shows how the individual fibre strands 24 are brought together one next to the other in the sliver guide means 51 and are scanned at a narrow point of the sliver guide means 51 by means of the feeler element 72 (measuring arm). The feeler element 72 is mounted in a pivot bearing 73, the lever arm 72*a* mechanically scanning the fibre slivers 24 and the lever arm 72*b* being acted upon by a compression spring 74. The lever arm 72*a* extends through a wall opening 51' in the sliver guide means 51. The distance sensor 22, which emits a beam 22', is arranged opposite and spaced apart from the spring-loaded lever arm 72*b*.

Figure 7:
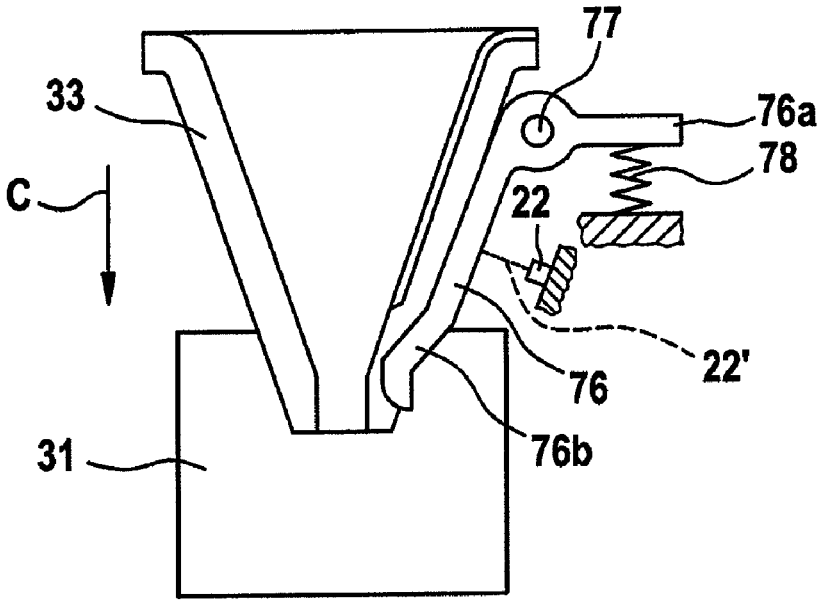
FIG. 7 is a plan view, in section, of the output-side sliver funnel for a fibre sliver downstream of the drafting system of a draw frame with a distance sensor opposite the scanning feeler element.

An individual fibre sliver (for example, see fibre sliver 34 in FIG. 4) can be scanned by, for example, an arrangement in accordance with FIG. 7. The sliver passes through the sliver funnel 33 in the direction of arrow C, is scanned mechanically by means of the feeler element 76. The feeler element 76 is mounted in a pivot bearing 77, the lever arm 76*b* scanning the fibre sliver 34 and the lever arm 76*a* being acted upon by a tension spring 78, one end of which is mounted on a fixed bearing. The lever arm 76*b* extends through a wall opening of the sliver funnel 33. The distance sensor 22, which emits measurement beam 22', is arranged opposite and spaced apart from the scanning lever arm 76*b*.

Figure 8:
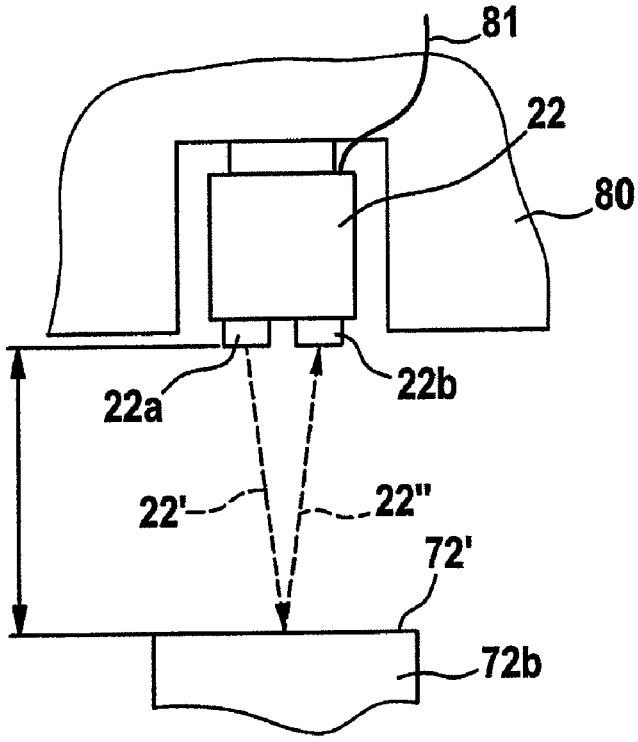
FIG. 8 shows the distance sensor (sensor that measures distance) with a transmitter and receiver.

One form of sensor suitable for use in an apparatus of the invention is shown in FIG. 8. The optical distance sensor 22 is arranged in fixed position in a recess, which is open on one side, in the holding element 80. The distance sensor 22 (light sensor) consists of a light transmitter 22*a* and a light receiver 22*b*. The light beam 22' emitted by the light transmitter 22*a* is reflected by the smooth surface 72' of the lever arm 72*b* (see FIG. 6) and the reflected light beam 22" is received by the light receiver 22*b*. Reference numeral 81 denotes an electrical line by means of which the distance sensor 22 is connected to an evaluating device (see electronic open- and closed-loop control device 60 in FIG. 4).

In the embodiment of FIG. 9, the movable feeler roller 65 of a tongue-and-groove roller pair 65, 66 is pivotally mounted by means of a lever arm 82*a* of a double-ended lever 82 on a fixed bearing 83. The distance sensor 22 is arranged opposite and spaced apart from the lever arm 82*b* which is biased by a tension spring 84.

FIG. 10 shows an embodiment, similar to FIG. 9, wherein, however, the distance sensor 22 is located opposite and spaced apart from the outside surface of the rotatable feeler roller 65.

Figure 11:
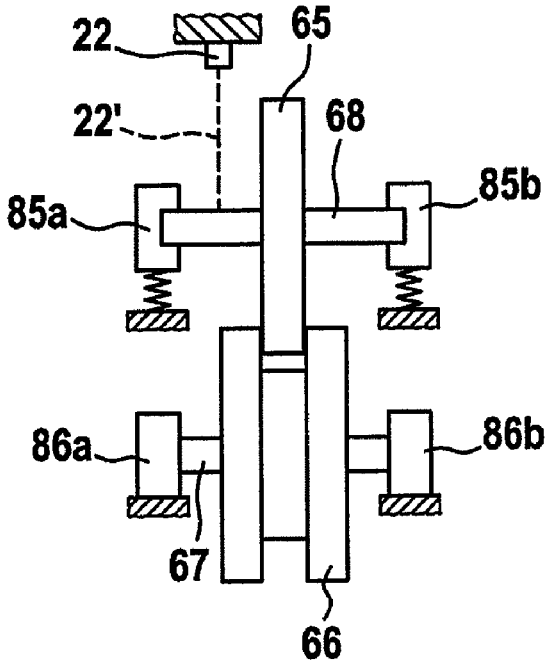
FIG. 11 is a front view of a tongue-and-groove roller pair in which a distance sensor is arranged opposite the movably mounted axis of the feeler roller.

In the embodiment of FIG. 11, the shaft 68 of the feeler roller 65 is mounted in movable bearings 85*a*, 85*b*. The shaft 67 of the groove roller 66 is mounted in two fixed bearings 86*a*, 86*b*. The fixed distance sensor 22 is arranged opposite and spaced apart from the rotatable and movable shaft 68.

Figure 12:
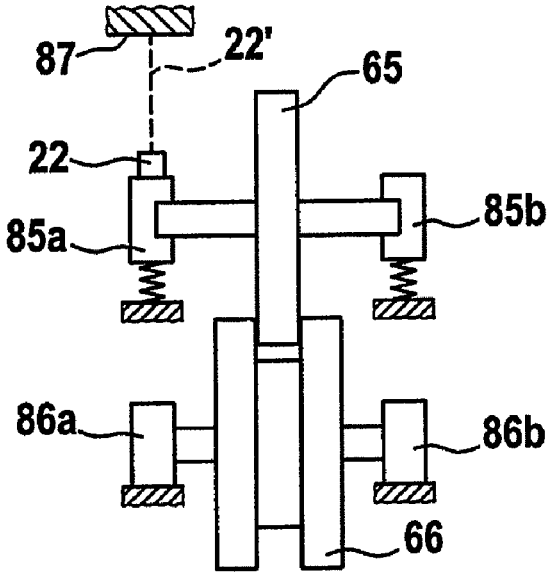
FIG. 12 shows a tongue-and-groove roller pair similar to that in FIG. 11 in which a distance sensor is arranged on a movable bearing for the feeler roller.

FIG. 12 shows a construction, similar to FIG. 11, wherein, however, the distance sensor 22 is arranged on the movable bearing 85*a* and is located opposite and spaced apart from a fixed counter-element 87.

Figure 13:
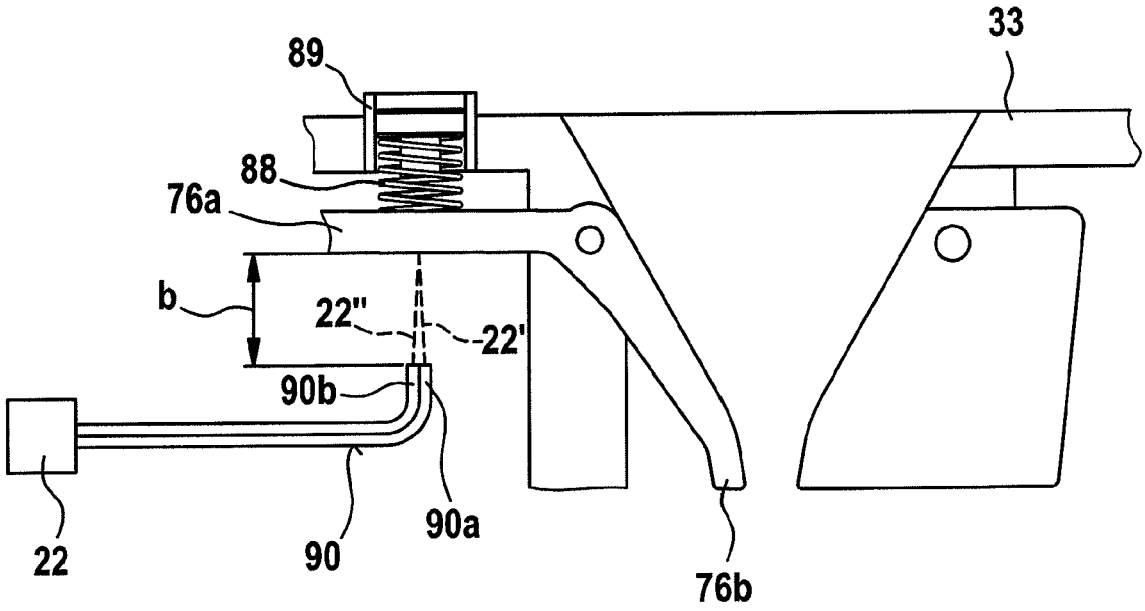
FIG. 13 shows a further embodiment in which a sliver funnel has an optical distance sensor and optical waveguide.

FIG. 13 shows an arrangement having a sliver funnel 33, a feeler tongue 76. The movable lever arm 76*a* is biased by one end of a compression spring 88 the other end of which is supported on a fixed bearing 89. The open end of a glass fibre cable 90 is located opposite and spaced apart by distance b from the side of the lever arm 76*a* facing away from the compression spring 88, the other end of the glass fibre cable 90 being connected to the distance sensor 22. The location of the distance sensor 22 has been moved away from the sliver funnel 33, for example it is arranged in a control box (not shown) or the like. The glass fibre cable 90 consists of two glass fibre strands 90*a*, 90*b*, one glass fibre strand 90*a* being used as transmitter and the other glass fibre strand 90*b* being used as receiver. The distance sensor 22 is an optical sensor, preferably a laser sensor. Such an embodiment offers inter alia the following advantages:

- measurement directly on the existing structure (roller, shaft end, feeler tongue, web lever, that is to say a high measuring frequency is possible),
- extremely simple integration of the sensor 22 is possible by means of optical waveguides 90.
- almost distance-independent (mm to a few cm),
- does not place high demands on the manufacturing process, because the sensor spacing b can be calibrated to the particular circumstances (teaching) and
- the use of optical waveguides 90 makes this measuring system virtually insensitive to interference.

Figure 14:
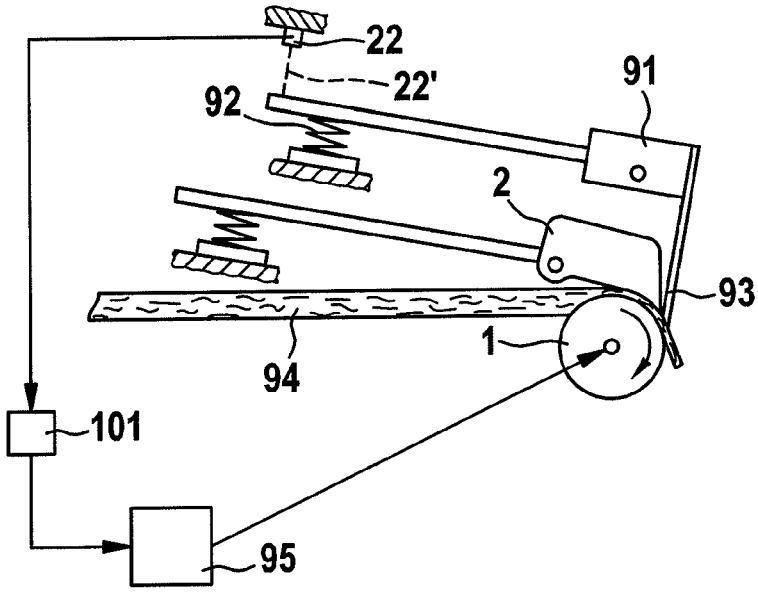
FIG. 14 shows a fibre tuft feed device on a flat card having a distance sensor arranged according to the invention.

FIG. 14 shows a feed arrangement suitable for a flat card, comprising an integral tray, for example of the type known as the SENSOFEED™ tray, made by Trützschler GmbH and Co. KG. and commonly used in combination with the TC 03 flat card (see FIG. 1) of the same company. The integral tray arrangement has feed roller 1, feed table 2 and a measuring lever 91 in the form of a double-ended lever, one lever arm of which is biased by a compression spring 92 and to the other lever arm of which there is attached a plurality of spring elements 93 (leaf springs) arranged one next to the other across the width. The feed table 2 feeds the fibre tuft fleece 94 to the spring elements 93. Each individual spring element 93 adapts itself exactly to the instantaneous mass of the fibre tuft fleece 94 being fed, that is to say in the event of mass fluctuations in the fibre tuft web 94 the spring elements 93 undergo different excursions. The excursions of all, for example ten, spring elements 93 are averaged by the measuring lever 91 and used as an actual value for the shortwave regulation. For that purpose, a distance sensor 22 is arranged opposite the end of the measuring lever 91 facing away from the compression spring 92, the distance sensor 22 being connected by way of a control device 101 to the variable speed drive motor 95 of the feed roller 1.

Figure 15:
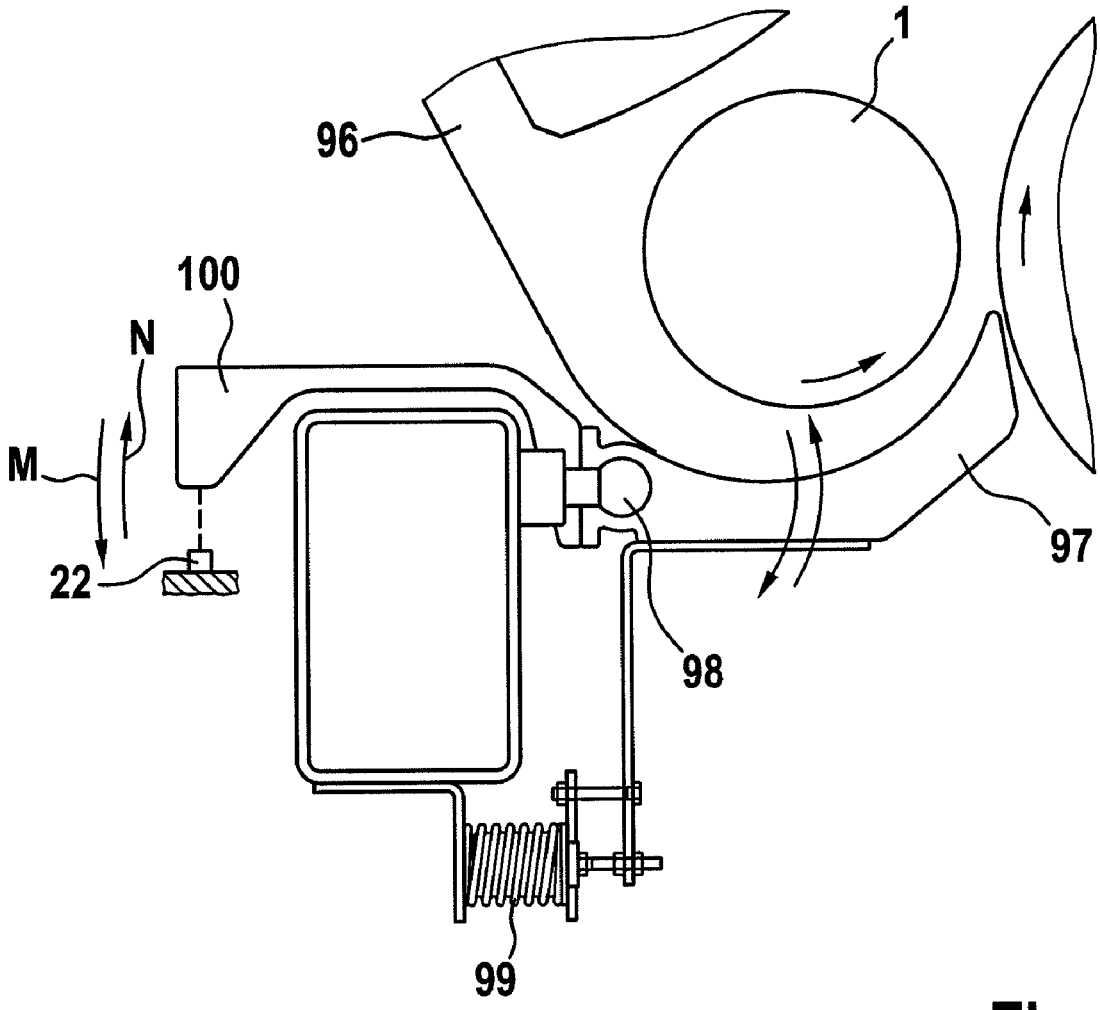
FIG. 15 shows a fibre tuft feed device on a roller card having a distance sensor arranged according to the invention.

In accordance with FIG. 15, a tuft feeder, for example a SCANFEED TF™ tuft feeder made by Trützschler GmbH & Co. KG. for a roller card, has across the width, at the lower end of the feed chute 96, a plurality of feed trays 97, each of which is articulated at one end on pivot joints 98. On the side facing away from the fibres, the feed trays 97 are mounted on one limb of an angled support, the other limb of which supports one end of a spring 99 the other end of which presses against an angled support mounted on the base wall. One end of an approximately U-shaped angled lever 100, which is pivotable at one end, is mounted on each of the pivot bearings 98. Distance sensors 22 according to the invention are located opposite and spaced apart from the free end of the angled levers 100—one for each feed tray 97. In that way, the pivoting of the feed trays 97 and the excursion of the lever arm 100 in the direction of arrows M,N generates an electrical pulse which corresponds to the excursion of the feed trays 97 that occurs in the event of a change in the thickness of the fibre material in the intake nip.

The invention is not limited to the embodiments shown and described. For example, the embodiments equipped with a tongue-and-groove roller pair 65, 66 (see FIG. 9. to 12) can be employed wherever delivery rollers are used, for example rollers 11, 12 (FIG. 1), rollers 31, 32 (FIGS. 2 and 4), rollers 46, 47 (FIG. 3), rollers 52, 53 (FIG. 4). The embodiments relating to a sliver funnel (FIG. 7, 13) can be used wherever an individual fibre sliver is being measured, for example web funnel 10 (FIG. 1), sliver funnel 33 (FIGS. 2 and 4), sliver funnel 44 and 45 (FIG. 3).

Also encompassed is that the distance sensors 22, $\mathbf{22}_1$, $\mathbf{22}_2$, $\mathbf{22}_3$, $\mathbf{22}_4$ shown in FIGS. 1 to 12, 14 and 15 can be connected to an optical waveguide 90 in accordance with FIG. 13 and in the manner shown in FIG. 13.

In the embodiments shown and described, the distance sensors 22, $\mathbf{22}_1$, $\mathbf{22}_2$, $\mathbf{22}_3$, $\mathbf{22}_4$—apart from FIG. 12—are mounted on fixed holding devices or the like, for example holding element 80 in FIG. 8, counter-element 87 in FIG. 12.

The distance sensors used in the embodiments described are non-contact sensors and, furthermore, rely upon transmitted waves. "Transmitted waves" as used herein includes any waves which are transmitted in the sense of being sent through a medium and, in particular, includes waves which have been reflected one or more times. Thus, "transmitted wave" includes an optical wave or an acoustic wave and the distance sensors used in accordance with the invention thus include distance sensors arranged to use optical waves or acoustic waves, but do not include induction sensors.

The invention is of particular application to continuously travelling fibre structures, especially individual fibre slivers, bundles of two or more, especially multiple, fibre slivers, and fibre webs.

The device of the invention may measure the mass of the fibre material directly or indirectly. In practice, it is expedient to measure a parameter other than mass, provided that the parameter other than mass is related to the mass. For the avoidance of doubt the expression "parameter related to mass" includes mass.

Although the foregoing invention has been described in detail by way of illustration and example for purposes of understanding, it will be obvious that changes and modifications may be practised within the scope of the appended claims.

What is claimed is:

1. An apparatus on a spinning preparation machine for ascertaining a parameter related to mass of a fibre material structure, comprising:

- a feeler element to mechanically contact the mass of the fibre material;
- a sensor device to detect a position of the feeler element, wherein the sensor device comprises a distance sensor that, to determine the position of the feeler element, is adapted to detect a transmitted wave; and
- an electrical evaluating device connected to the sensor device.

2. An apparatus according to claim 1, wherein the distance sensor ascertains distances relative to the feeler element.

3. An apparatus according to claim 1, further comprising a counter-element associated with the feeler element, wherein the distance sensor ascertains distances relative to the counter-element, and wherein at least one of the distance sensor and the counter-element are movable.

4. An apparatus according to claim 3, wherein the counter-element includes a flat or curved scanning surface.

5. An apparatus according to claim 4, wherein the scanning surface is reflective.

6. An apparatus according to claim 1, wherein the distance sensor comprises an optical distance sensor.

7. An apparatus according to claim 1, wherein the distance sensor comprises a laser scanner, or wherein the distance sensor uses visible light or infrared light.

8. An apparatus according to claim 1, wherein the distance sensor comprises an acoustic distance sensor.

9. An apparatus according to claim 1, wherein the distance sensor comprises an ultrasound distance sensor.

10. An apparatus according to claim 1, wherein the distance sensor includes a transmitter and a receiver.

11. An apparatus according to claim 1, further comprising an optical waveguide to conduct signals from a measuring point to the electrical evaluating device.

12. An apparatus according to claim 1, wherein the feeler element comprises one of a movable feeler tongue, or a movable feeler roller.

13. An apparatus according to claim 1, wherein the distance sensor is adapted to measure sliver mass in a continuously moving fibre bundle.

14. An apparatus according to claim 13, further comprising at least one drafting device of the spinning preparation machine in which the fibre structure is being drafted, wherein measured values for sliver mass are used to level fluctuations in the sliver mass of the fibre bundle by controlling the at least one drafting device.

15. An apparatus according to claim 1, further comprising a regulating unit and at least one drafting device of the spinning preparation machine, wherein based on calculated values for the sliver mass, the regulating unit effects open-loop control of the at least one drafting devices to even out sliver mass fluctuations.

16. An apparatus according to claim 1, further comprising a regulating unit and at least one drafting device of the spinning preparation machine, wherein based on calculated values for sliver mass, the regulating unit effects closed-loop control of the at least one drafting device to even out sliver mass fluctuations.

17. An apparatus according to claim 1, further comprising an open- and closed-loop control device connected to the evaluating device, wherein the control device includes an inlet and outlet autolevelling device to effect simultaneous open-loop and closed-loop control of the spinning preparation machine.

18. An apparatus according to claim 1, wherein a distance sensor is arranged at at least one of the inlet or the outlet of a drafting system of the spinning preparation machine.

19. An apparatus according to claim 1, wherein transmitted waves are used for resonance frequency matching, wherein a measuring frequency at which the matching is carried out is matched to one of an inlet speed of a fibre structure entering the spinning preparation machine or a delivery speed of a fibre structure leaving the spinning preparation machine.

20. An apparatus according to claim 19, wherein the measuring frequency is matched to a fixed scanning length.

21. An apparatus according to claim 19, wherein the measuring frequency is matched to a fixed time period which depends upon a speed of the fibre structure.

22. An apparatus according to claim 19, wherein the apparatus is adapted to scan a certain portion of the fibre structure per measurement by carrying out a plurality of overlapping measurements displaced relative to one another along a fibre bundle.

23. An apparatus according to claim 1, wherein the apparatus is adapted to create a spectrogram or a partial spectrogram of the fibre structure based on measured values obtained by the distance sensor.

24. An apparatus according to claim 1, further comprising one of a sliver guide element or a web guide element, wherein the feeler element is coupled to the sliver guide element or the web guide element.

25. An apparatus according to claim 1, further comprising a sliver funnel through which a single fibre sliver passes, wherein the feeler element is coupled to the sliver funnel.

26. An apparatus according to claim 1, further comprising a plurality of distance sensors and feeler elements, wherein each of the distance sensors scans the thickness of a fibre sliver with a respective feeler element.

27. An apparatus according to claim 26, wherein displacements of the respective feeler elements can be added together.

28. An apparatus according to claim 1, further comprising a guide device provided upstream and downstream of the sensor to guide the fibre material under tension.

29. An apparatus on a spinning preparation machine, including one of a flat card, roller card, draw frame, combing machine or the like, for ascertaining at least one of a mass or fluctuations in the mass of a fibre material, including at least one fibre sliver, fibre web or the like, of cotton, synthetic fibres or the like, comprising:

a feeler element to mechanically contact the fibre material, the excursions of which are converted into electrical signals;

a contactless distance sensor to detect a position of the feeler element, wherein the distance sensor, using waves or rays, comprises a sensor that measures distance; and an electrical evaluating device connected to the distance sensor.

30. A spinning preparation machine, comprising:

a feeler element that, in use, contacts a continuously moving fibre structure; and an apparatus to detect a position of the feeler element, wherein the apparatus includes at least one distance sensor to contactlessly detect the position of the feeler element and to non-inductively measure a parameter related to a sliver mass of a continuously moving fibre structure.

* * * * *